US012800263B2

(12) United States Patent
Criss

(10) Patent No.: US 12,800,263 B2
(45) Date of Patent: Nov. 17, 2026

(54) BED ENGAGEABLE GUN MOUNT

(71) Applicant: William Criss, Mesa, AZ (US)

(72) Inventor: William Criss, Mesa, AZ (US)

( * ) Notice: Subject to any disclaimer, the term of this patent is extended or adjusted under 35 U.S.C. 154(b) by 0 days.

(21) Appl. No.: 19/457,097

(22) Filed: Jan. 22, 2026

(65) Prior Publication Data

US 2026/0210668 A1 Jul. 23, 2026

Related U.S. Application Data

(60) Provisional application No. 63/748,415, filed on Jan. 22, 2025.

(51) Int. Cl.
*F41A 23/18* (2006.01)
*F41C 33/04* (2006.01)

(52) U.S. Cl.
CPC ..... *F41C 33/041* (2013.01); *F41A 23/18* (2013.01)

(58) Field of Classification Search
CPC ..... F41A 23/18; F41C 33/04; F41C 33/041; A47B 81/005
See application file for complete search history.

(56) References Cited

U.S. PATENT DOCUMENTS

2016/0153746 A1* 6/2016 Higgins ..... F41C 33/0209 5/503.1
2022/0232971 A1* 7/2022 Phillips ..... F41C 33/06
2026/0116308 A1* 4/2026 Broussard ..... B60R 7/14

* cited by examiner

*Primary Examiner* — J. Woodrow Eldred
(74) *Attorney, Agent, or Firm* — Donn K. Harms

(57) ABSTRACT

A firearm mount is provided having a body configured for a compressive coupling with a frame member of a bedframe. A magnet coupled to the body provides for a magnetic coupling between a firearm and the body. The magnetic coupling holds the firearm, such as a pistol in a gripping position, hidden under overhanging bedding. The firearm in the gripping position is easily grasped by a user lying on the bedframe without needing to view it.

20 Claims, 6 Drawing Sheets

BED ENGAGEABLE GUN MOUNT

This application claims priority to U.S. Provisional Patent Application Ser. No. 63/748,415 filed on Jan. 22, 2025.

BACKGROUND OF THE INVENTION

1. Field of the Invention

The invention herein disclosed relates generally to firearm mounts. More particularly, it relates to a mount having a magnetic engagement for a firearm, which is configured for operative engagement with a metal bed frame substantially hidden from sight.

2. Prior Art

Background of the Invention

Hidden firearm mounts are a discreet and innovative solution for securely storing firearms while keeping them out of sight. Many such mounts are designed to blend seamlessly into various environments, ensuring that firearms remain both accessible and concealed. Common examples include wall-mounted systems that hide behind artwork, mirrors, or false panels, but allow for quick access when necessary, while keeping the weapon hidden from view in everyday settings. Such mounts are especially popular for home defense, where security and stealth are paramount. In addition to their concealment function, hidden firearm mounts often include safety features like biometric or combination locks, enhancing security while allowing for rapid retrieval when needed.

Such firearm mounts cater to individuals who value both safety and privacy, ensuring that firearms are not overly visible to children, guests, or intruders while still being within easy reach for the owner. Hidden mounts can also be installed in less conventional spaces, such as inside furniture pieces like bookshelves or under tables, offering a high level of customization for different living situations. As the demand for personalized security solutions rises, these concealed mounts are becoming a popular choice for those looking to maintain a safe, yet non-intrusive, living environment. Whether for tactical purposes or simply for peace of mind, hidden firearm mounts combine functionality with discretion.

With respect to the above, before explaining at least one preferred embodiment of the bed frame engaged gun mount and method herein, it is to be understood that the disclosed bed engageable gun mount device herein is not limited in its application to the details of employment and to any arrangement of steps set forth in the following description or illustrated in the drawings. The bed frame engageable gun mount apparatus components, and configurations thereof, and methods of employment thereof, as herein disclosed, are capable of other embodiments, and of being practiced and carried out in various ways by those skilled in the art subsequent to their review of this specification.

Also, it is to be understood that the phraseology and terminology employed herein are for the purpose of description for an understanding of the bed-engageable gun holding device and method herein, and should not be regarded as limiting. As such, those skilled in the art will appreciate that the conception upon which this disclosure is based may readily be utilized as a basis for other magnetic gun holding devices which are adapted for engagement with a bed frame. It is important, therefore, that the embodiments, objects, and claims herein be regarded as including such equivalent construction and methodology insofar as they do not depart from the spirit and scope of the present invention.

SUMMARY OF THE INVENTION

The hidden gun mount device and system herein provide a solution to the positioning of a firearm proximate to a bed wherein the bed occupant can easily reach and grasp the firearm in their hand, if and when needed. The firearm mount device features a body that is configured for a compressive engagement with a horizontal rail of a conventional bed frame. Many widely employed metal bed frames are formed of L-shaped metal beams, such as the conventional sliding adjustable bed frame having metal beams which are 1½" wide×1½" tall. Such is widely used and sold for positioning under a mattress or box springs to hold the assembled bed elevated above the floor surface. Other bed frames are formed of rectangular tubing.

The body of the gun mount herein described and shown includes a central wall having a compressive connector engaged therewith. Currently, the compressive connector is a threaded member that may be rotated to impart compression of the bed frame rail against opposing side rails of the gun mount. A first side rail extends substantially perpendicular from the central wall to a first distal end section, which curves or extends from the first side wall to a position over the central wall. A second side rail extends substantially perpendicular from an opposing side of the central wall to a second distal end, which angles downward in a direction toward the central wall.

Removably compressive engagement of the body is accomplished by positioning the central wall in a position underneath a first portion of the bed frame member, where the first distal end section is located above the first portion of the bed frame member, and the second distal end is engaged over the vertical wall portion of the bed member. As the threaded member of the compressive connector is rotated in a threaded engagement to the central wall, it will bias the central wall of the body in a direction away from the first portion of the bed member. Once the first distal end is compressively engaged against the first portion of the bed member and the second distal end is compressively engaged over the vertical second portion of the bed member, the body is held in a compressive engagement to the bed frame member elevated from the floor.

In forming such an elevated coupling to the bed frame, it positions the magnetically coupled or holstered firearm, elevated above the floor and also hidden behind the bedding, such as sheets and blankets. Such bedding blankets and sheets, and the like, conventionally hang from the sides of the bed and bed frame side rail, anywhere from 10-24 inches below the horizontal side rail to which the firearm is coupled by the device herein. This is an important consideration in that the firearm is preferably hidden from sight but easily available in a gripping position for use with the handle and trigger easily gripped and actuated.

A magnetic connector is coupled to an exterior surface of the second sidewall, wherein it is visible when bed covers are pulled away from the elevated gun mount body. The magnetic connector preferably is coated with a polymeric, rubber, or similar material to provide a contact surface for the firearm, which will avoid scratching. Additionally, the polymeric surface is preferably smooth to provide a more attractive mounting surface for an engaged firearm thereon, which is slip-resistant to thereby avoid having the firearm in magnetic engagement with the magnetic connector, sliding off of such an engagement.

In a preferred configuration of the magnetic connector within the polymeric surrounding coating is positioned a magnetically attractive metal plate. On a first side of the metal plate is positioned a plurality of magnets, each alternating between magnetic north and magnetic south from such magnets positioned adjacent. Thus, where four magnets are so positioned, the first would have a north magnetic positioning facing the metal plate, and a second magnet would have a south magnetic positioning, and so on.

This alternating north-south positioning of adjacent magnets has been found to impart a significantly stronger magnetic attraction to the metal plate and is preferred.

As noted, a polymeric coating covers at least the magnetic plate and preferably the entire magnetic connector. Covering the plate with a smooth or patterned surface coating, as noted, prevents firearm slippage when magnetically held against the magnetic connector.

In use, with the body of the mount engaged with the horizontal section of a bed frame, the magnetic connector is held elevated above the floor and above the bottom of the mattress or box springs. In this position, when a firearm such as a pistol is positioned to a magnetic removable coupling with the magnetic connector, the pistol is also held elevated. Thereafter, the bed covering, such as blankets, duvets, or the like, may be draped over the side of the bed to cover the firearm and the mount. So covered, the firearm is stealth or hidden but easily reached by an occupant of the bed or the bedroom, if needed.

As noted, the body of the firearm mount herein is shown and described in one mode as configured for an L-shaped conventional mattress support rail. It should be noted that the body may be configured for a compressive engagement with a rectangular or tube-type rail of wood or metal to provide an elevated magnetic coupling for a firearm to an elevated position hidden by bedding, but easily reached when needed.

With respect to the above summary description, before explaining at least one preferred embodiment of the bed frame engageable magnetic gun holding device and method herein, it is to be understood that the invention is not limited in its application to the details of operation, nor the arrangement of the components or the steps set forth in the following description or illustrations in the drawings. The various methods of implementation and operation of the bed frame engageable magnetic gun holding device and method herein are capable of other embodiments and of being practiced and carried out in various ways, which will be obvious to those skilled in the art upon their review of this disclosure. Also, it is to be understood that the phraseology and terminology employed herein are for the purpose of description and should not be regarded as limiting.

Therefore, those skilled in the art will appreciate that the conception upon which this disclosure is based may readily be utilized as a basis by others for the designing of other bed-engageable gun mount configurations for carrying out the several purposes of the present gun mount herein. Therefore, the objects and claims herein should be regarded as including such equivalent construction, steps, and methodology insofar as they do not depart from the spirit and scope of the present bed frame engageable gun holder invention.

As used in the claims to describe the various inventive aspects and embodiments, "comprising" means including, but not limited to, whatever follows the word "comprising." Thus, use of the term "comprising" indicates that the listed elements are required or mandatory, but that other elements are optional and may or may not be present. By "consisting of" is meant including, and limited to, whatever follows the phrase "consisting of." Thus, the phrase "consisting of" indicates that the listed elements are required or mandatory, and that no other elements may be present. By "consisting essentially of" is meant including any elements listed after the phrase, and limited to other elements that do not interfere with or contribute to the activity or action specified in the disclosure for the listed elements. Thus, the phrase "consisting essentially of" indicates that the listed elements are required or mandatory, but that other elements are optional and may or may not be present depending upon whether or not they affect the activity or action of the listed elements. Where used herein, if not otherwise defined, the term "substantially" means plus or minus five percent.

It is an object of this invention to provide a bed frame engageable firearm mount which will provide a concealed positioning of a firearm that is within reach of the bed occupant but hidden behind bedding.

It is a further object of this invention to provide such a bed frame engageable gun mount which provides a mechanical or compressive engagement to the bed frame to an elevated position above the floor, along with a magnetic removable engagement for a firearm held positioned thereon.

These, together with other objects and advantages, which become subsequently apparent, reside in the details of the construction and operation of the disclosed bed frame engageable gun mount herein as more fully hereinafter described and claimed, reference being had to the accompanying drawings forming a part thereof, wherein like numerals refer to like parts throughout.

Further objectives of this gun positioning invention may be ascertained by those skilled in the art, as brought out in the following part of the specification, wherein a detailed description is for the purpose of fully disclosing the invention without placing any limitations thereon.

BRIEF DESCRIPTION OF DRAWING FIGURES

The accompanying drawings, which are incorporated herein and form a part of the specification, illustrate some but not the only or exclusive examples of embodiments and/or features of the disclosed bed frame engageable mount for a firearm and method of employment thereof herein. It is intended that the embodiments and figures disclosed herein are to be considered illustrative of the invention herein, rather than limiting in any fashion.

DETAILED DESCRIPTION OF THE PREFERRED EMBODIMENTS OF THE INVENTION

Figure 1:
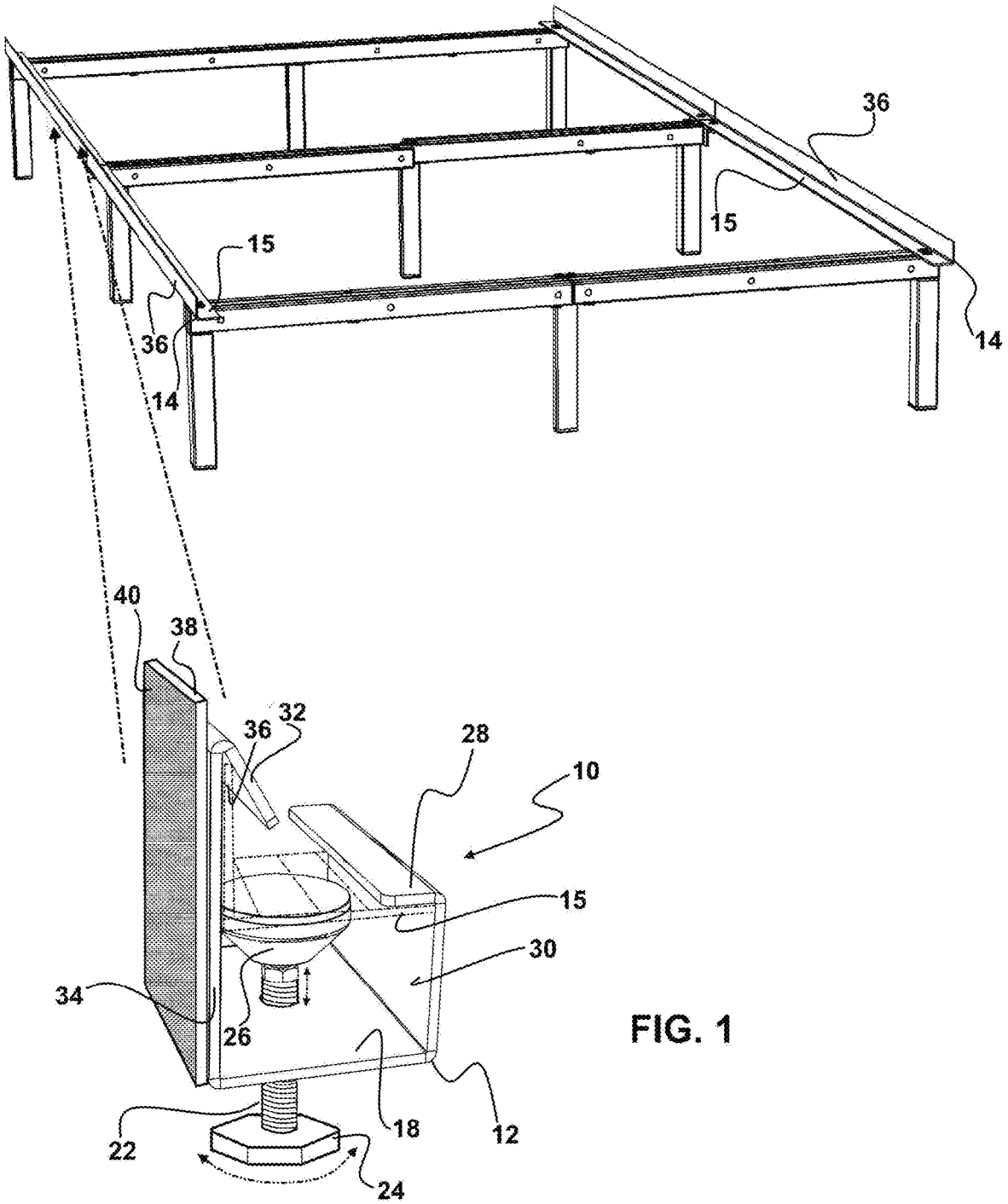
FIG. 1 shows a graphic depiction of the gun mount herein and the operative positioning thereof upon a conventional metal bed frame formed of L-shaped metal, which is widely used.

In this description, the directional prepositions of up, upwardly, down, downwardly, front, back, top, upper, bottom, lower, left, right, first, second, and other such terms refer to the bed frame engageable gun mount and operative components thereof as they are oriented and appear in the drawings and all such terms are used for convenience only and such are not intended to be limiting or to imply that the bed frame engageable gun mount device and system has to be used or positioned in any particular orientation.

Now referring to drawings in FIGS. 1-9, either as a group of drawings or individually, there is seen in FIG. 1, a graphic depiction of the gun mount device 10 herein having a body which is configured for removable operative coupling with a frame member 14 of a bed frame where the frame member 14 is generally "L" shaped or in some cases rectangular. As noted, such frame members 14 or side rails are widely employed on conventional bed frames 16, which are adapted to support a mattress 17 (FIG. 8) thereon, wherein opposing frame members 14 or side rails support the mattress 19 substantially centered therebetween on the bed frame 16.

Figure 2:
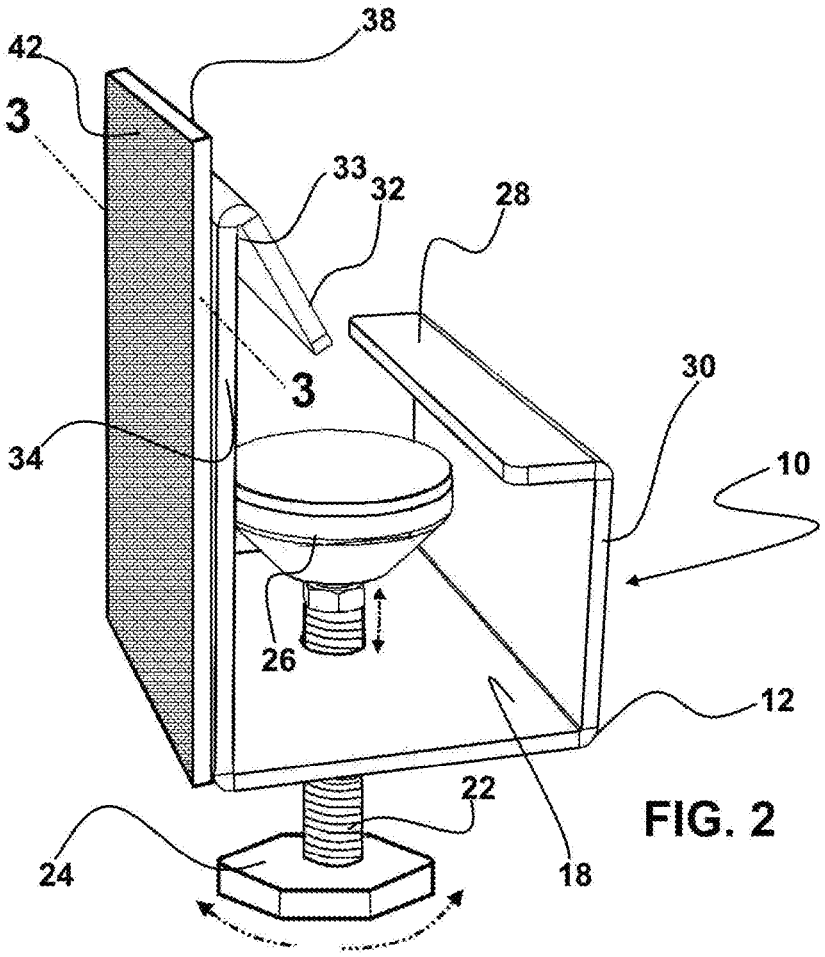
FIG. 2 shows the gun mount herein, showing a magnetic connector mounted to a U-shaped body, which is configured for compressive engagement with a rail of a metal bed frame.

As shown in FIGS. 1 and 2, the body 12 of the device 10 in this configuration has a center wall 18 through which a compression component 20 is operatively engaged. The compression component employs a threaded member 22, which is in a threaded engagement with the center wall 18. Rotating the threaded member 22, such as with knob 24, will cause it to translate within the threaded engagement with the body 12 or center wall 18.

As can be seen in FIGS. 1 and 2, rotating the threaded member 22 in one direction will cause a connector 26 to move toward and away from the horizontal projection 28 extending substantially normal from a vertically disposed first sidewall 30.

The horizontal projection 28 extends to a distal end above and substantially parallel to the center wall 18. So positioned, when the connector 26 is translated by rotation of the threaded member 22 toward the horizontal projection 28, a horizontal portion 15 of the frame member 14 may be positioned between the connector 26 and the horizontal projection 28 to a compressive contact or coupling.

In this compressive coupling, such as to a bed frame in FIG. 1, a distal end of the vertically disposed portion 17 of the frame member 14 is positioned at the connection point 33 of an angled section 32 extending from a distal end of the second sidewall 34. This angled section 32 extends at a downward angle toward the center wall 18 from the distal end of the second sidewall 34.

As such, as the connector 26 translates toward and against the horizontal portion 15 of a side rail or frame member 14, it causes a compression of the horizontal projection 28 against one side of the horizontal portion 15 of the frame member 14 and a compression of the distal end of a secondary sidewall 36 of the bed frame member 14 against the connection point 33. This forms a compressive coupling of the body 12 to the frame member 14, which is very secure and resists movement or rotation. The same compressive coupling is provided by the device as in FIGS. 5 and 6.

When located to this compressive coupling, a magnet 38 connected to the body 12, such as at the second sidewall 34 of the body 12, is held in an operative position adjacent an outside edge of the secondary sidewall 36 of the frame member 14. So located, the magnet 34 will magnetically couple a magnetically attractive firearm 40 and hold it in an elevated position adjacent the outside surface or sidewall 36 of the frame member 14, where it may be easily dismounted by a user pulling it from the magnetic coupling. This positioning also locates the firearm in a stealth coupling to the bed frame 16 behind the bedding 21 (FIG. 8), such as blankets or sheets or similar conventional bedding which hangs down from the sides of the bed frame 16 generally below the side wall 36 of the side rail or frame member 14.

Figure 3:
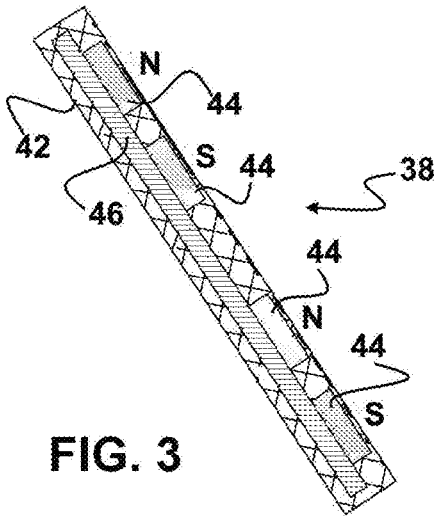
FIG. 3 shows a sectional view through the magnetic connector showing the alternating magnetic poles of a plurality of magnets positioned adjacent a magnetically attractive metal section, all of which are surrounded by a polymeric coating.

One configuration of the magnet 38 is shown in a sectional view of FIG. 3. While the magnet 38 might be a simple planar magnet having an engagement surface 42 thereon, which will magnetically couple the firearm 40, another preferred configuration of the magnet 38 is shown in FIG. 3. As shown, a plurality of smaller magnets 44 are placed in magnetic connection with a magnetically attractive metal plate 46. The metal plate 46 has the engagement surface 42 located thereon, which is preferably smooth, and has shown to better magnetically couple with the firearm 40.

Further, each of the plurality of secondary magnets 44 in a sequence has an opposite magnetic polarity. By opposite magnetic polarity is meant in the sequence, one magnet 44 has the south pole adjacent the plate 46, while the adjacent magnet 44 in the sequence thereof will have the north pole thereof adjacent the plate 46. Such an alternate positioning of the sequentially located magnets 44 has shown in experimentation to provide a stronger magnetic coupling of the plate 46 to the firearm 40 to hold it steady.

Figure 4:
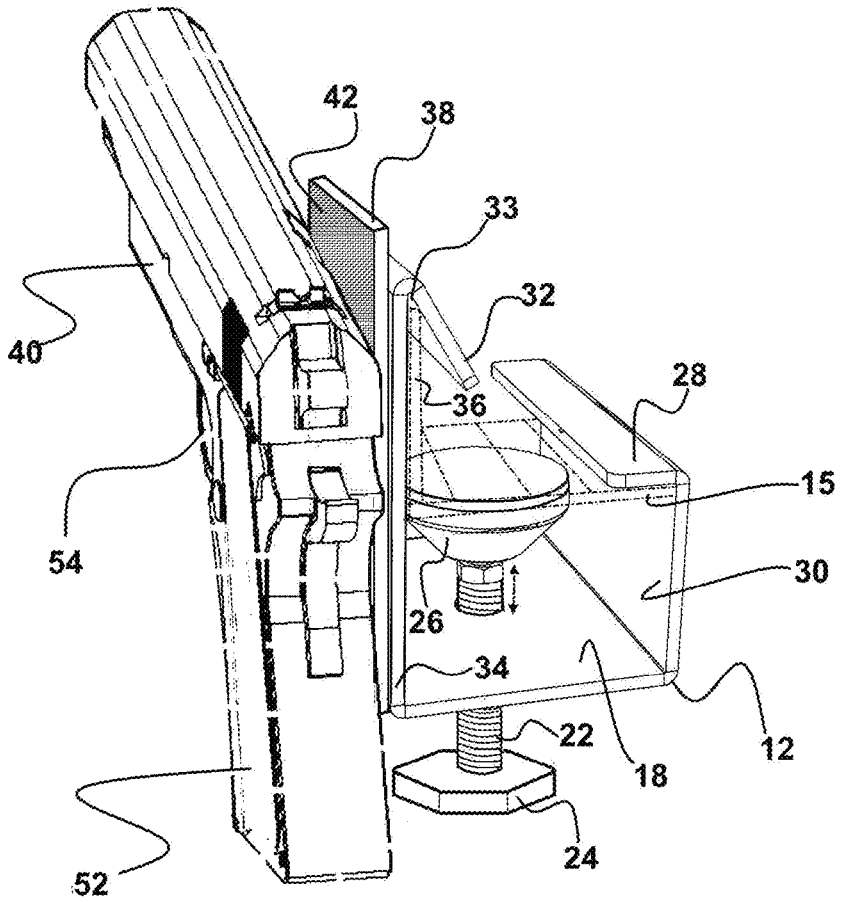
FIG. 4 shows the gun mount device herein having a firearm, such as a pistol, magnetically coupled against the planar magnetic connector, where it is in a gripping position, where it may be easily reached and removed.
Figure 8:
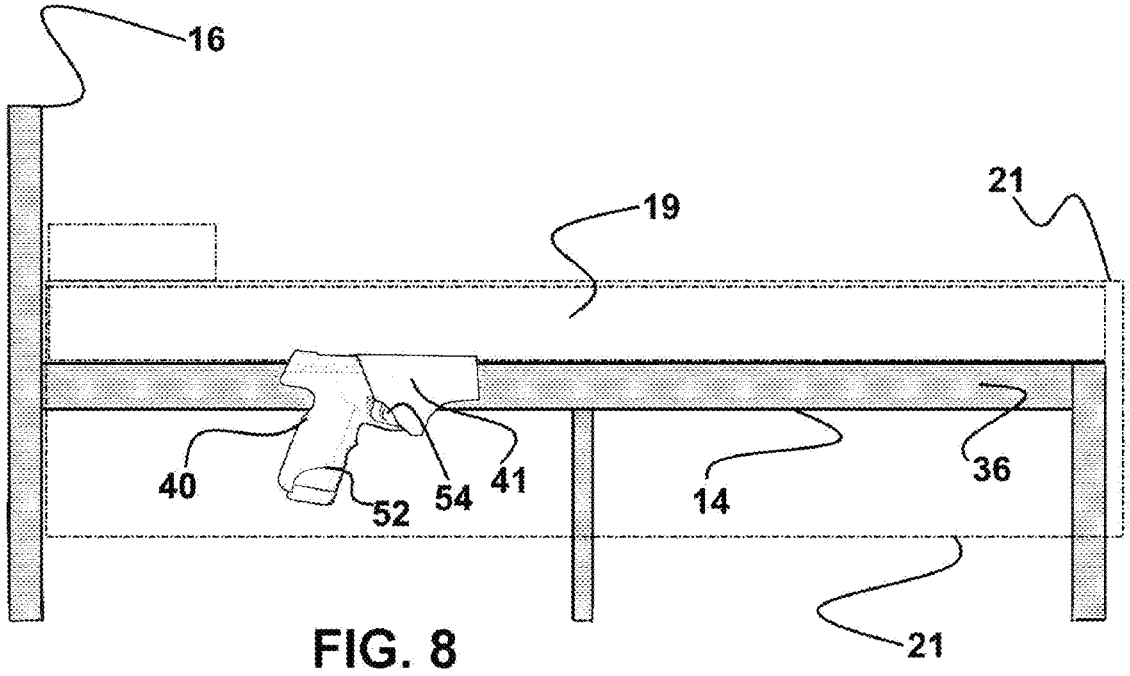
FIG. 8 depicts the device herein having a holster providing the removable coupling of a firearm to the mounted device and showing the stealth-positioning thereof in a gripping position behind bedding hanging below the side rail.

The employment of the device 10 for the magnetic coupling of a firearm 40, such as a pistol firearm 40, is shown in FIG. 4 and FIG. 8. As shown, the firearm 40 is shown in FIG. 4 in a removable magnetic coupling to the engagement surface 42 of the magnet 38. Such would be the magnetic coupling achieved by the device 10 of FIGS. 1-4 and of FIG. 5. The magnetic coupling may also be formed using a holster 41, which is magnetically coupled to the body 12 or may be otherwise coupled thereto, as in FIG. 8. The magnetic field from the magnet 38 or magnets 44 will communicate into the cavity of the holster 41 and thereby magnetically couple the firearm 40 to the body 12 of the device 10.

Figure 5:
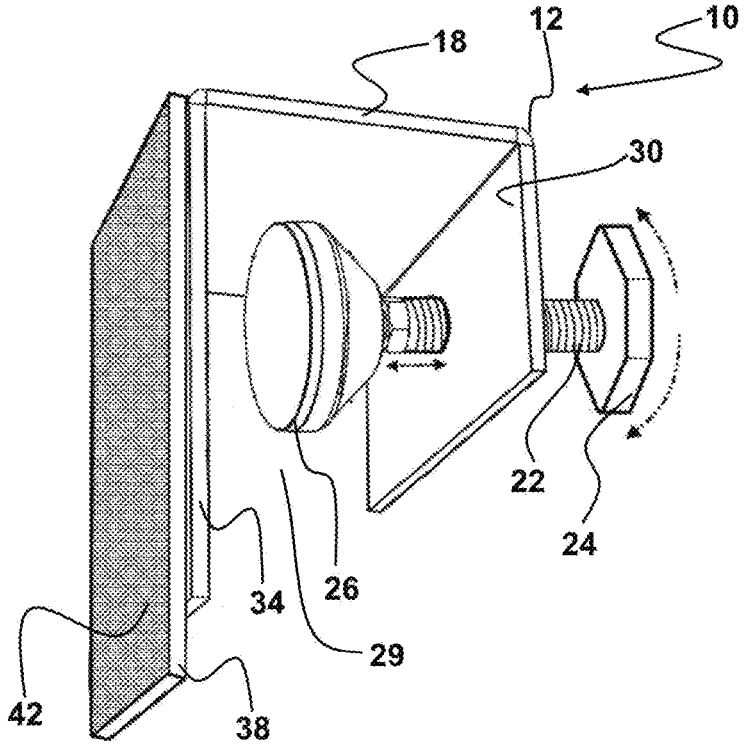
FIG. 5 depicts a mode of the device having a body configured for engagement to a bed frame having rectangular tubing, such as those formed of metal or wood.
Figure 6:
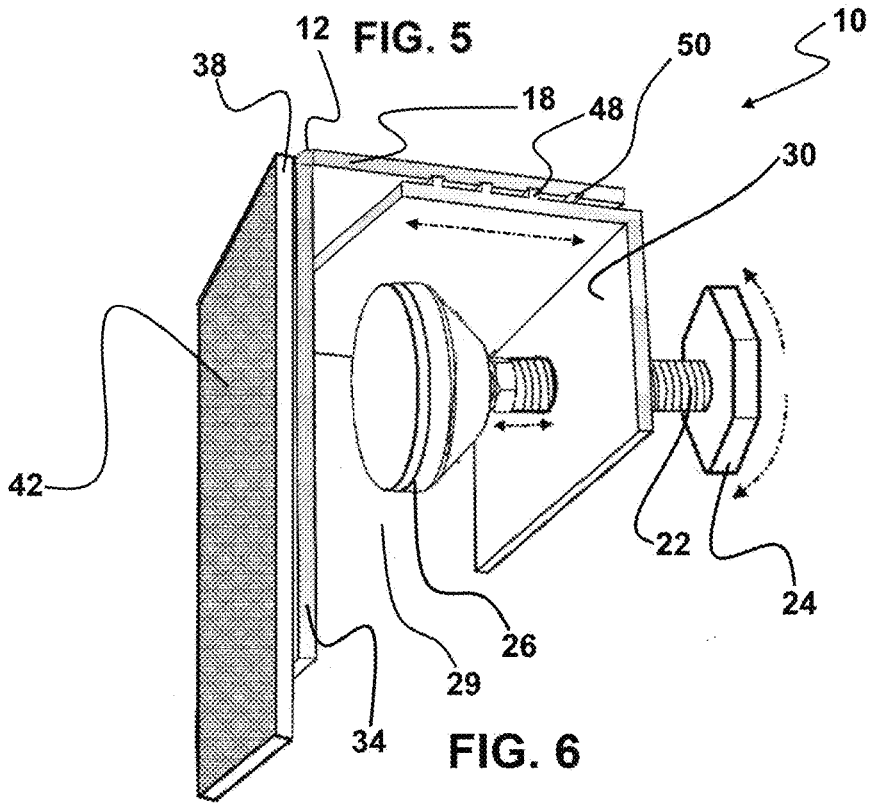
FIG. 6 depicts a mode of the device wherein the body forming the compressive connection is adjustable in width.
Figure 7:
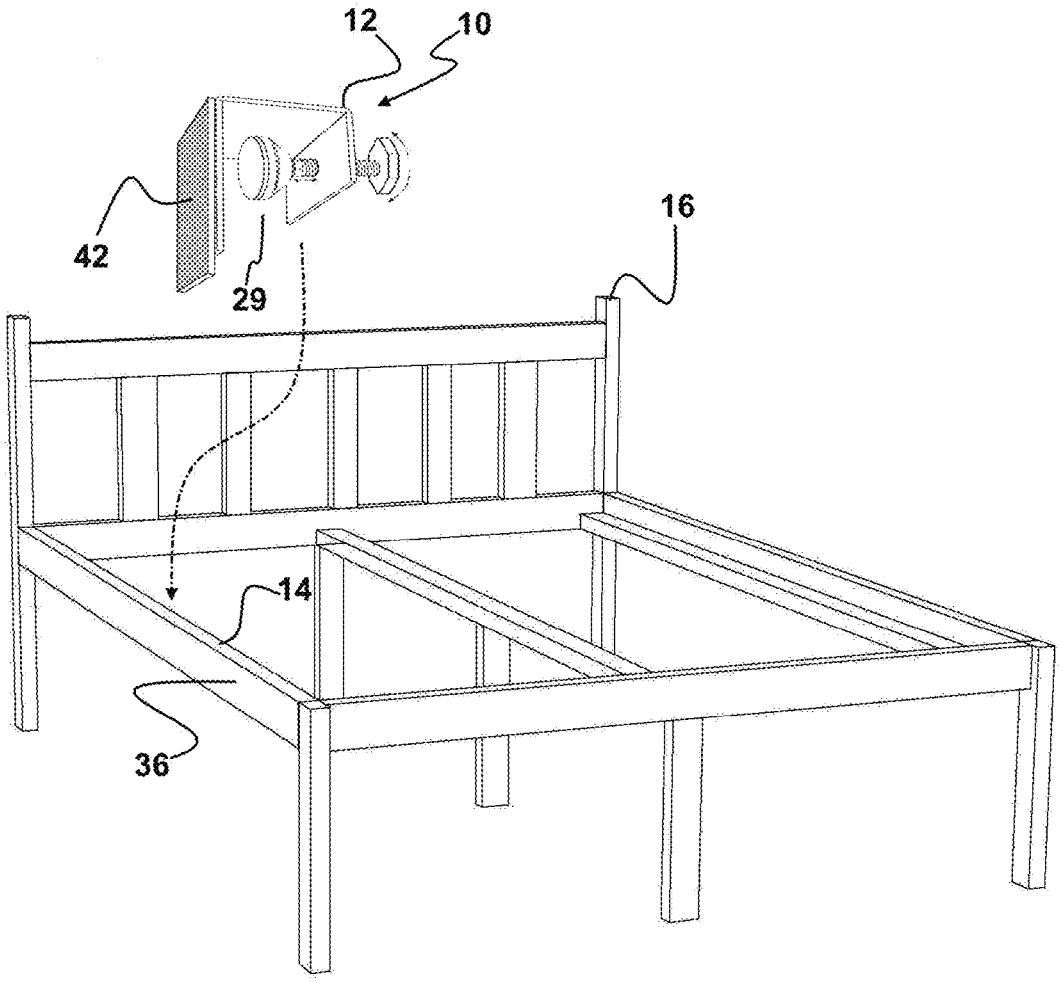
FIG. 7 shows the device herein, such as in FIGS. 5-6, for engagement with a bedframe formed of rectangular members.

As noted, where a bed frame is formed with rectangular tubing for the frame members 14 instead of L-shaped members, such as in FIGS. 7 and 8, the device 10 can be configured as in FIGS. 5 and 6 to achieve a coupling of the body 12 to such rectangular frame members 14. In this configuration, the threaded member 22 of the body 12 is in a threaded engagement with the first sidewall 30, and translation thereof across the gap 29 moves the connector 26 toward and away from the second sidewall 34 of the body 12. A rectangular frame member positioned in the gap 29 between the connector 26 and the second sidewall 34 can be compressibly coupled therebetween to hold the body 12 in a compressible coupled position on a bed frame with rectangular frame members 14. So positioned, the firearm 40 may be removably magnetically coupled to the body 12 with the magnet 38 in the same fashion as the device 10 of FIGS. 1-4.

The device 10 may also be configured with a body 12 adapted to engage either an L-shaped frame member 14 or a rectangular frame member 14. Such may be accomplished, for example, by forming a removable connection of the upper half of the second sidewall 34 with the angled section 32 extending therefrom to a lower portion of the second sidewall 34, and a removable horizontal extension from a lower half of the second sidewall 34. Slots or fasteners may be used to hold the removable sections to the lower portion. In this fashion, the user could configure the body 12 to the type of bed frame they have.

An adjustable configuration of the body 12 is shown in FIG. 6. As shown, the second sidewall 34 is positionable closer to or further from the first sidewall 30 to change the size of the gap 29 therebetween to accommodate the thickness of a bedframe 16, frame member 14, or side rail. As shown in FIG. 6, ribs 16 can be positioned into mating slots 50 with the first sidewall 30 at differing distances from the second sidewall 34. When the compressive coupling with the bed frame 16 frame member 14 is achieved, the compressive force will hold the ribs 48 in place in the chosen slots 50. This works especially well to minimize lost parts since no screws or fasteners are required; however, other means for adjustable positioning of the two components may be used, such as screws and openings.

This size-adjustable mode of the device 10, with the adjustable gap 29, may be better adapted for coupling with rectangular frames, such as in FIGS. 7 and 8, since the width of the metal or wood on the frame member 14 can vary by manufacturer.

In FIG. 8 is depicted the device 10 herein having a holster 41 coupled to the second sidewall 34 of the body 12. This coupling may be mechanical, such as with fasteners or magnetic, where the holster 41 has a magnetically attractive body portion to couple with the magnet 38. The holster 41 is preferable to the removable coupling of an inserted firearm 40 to the mounted body 12 of the device 10. Also shown in FIG. 8 is the stealth positioning of the firearm 40, which would occur in all modes of the device 10 herein, where it is located behind bedding 21 hanging below the frame member 14 or side rail. As noted, conventionally, such bedding 21 will hang below the bottom edge of such frame members 14 a distance from 10-24 inches and thereby cover the coupled firearm 40. Also shown in FIG. 8 and FIG. 4 is the device 10 coupling the firearm 40 held in a gripping position with the barrel thereof positioned horizontally. This locates the handle 52 and trigger 54 easily gripped by a user without viewing the firearm 40 for quick acquisition and use, even in a darkened room or while lying down upon the mattress 19 of the bed.

Figure 9:
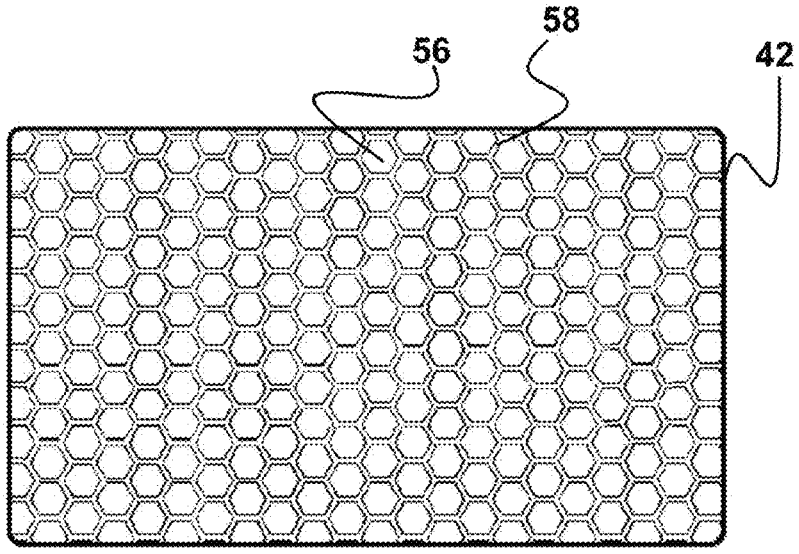
FIG. 9 shows a preferred configuration of a relief pattern of hexagons, which has shown in experimentation to provide a firm, removable magnetic coupling of the firearm.

Finally, shown in FIG. 9, is a preferred configuration of a relief pattern in the engagement surface 42 of projecting hexagons 56 surrounded by a slight relief or perimeter slot 58 around the perimeter thereof. Such has shown in experimentation to provide a very firm removable magnetic coupling of the firearm 40 to the body 12.

While all of the fundamental characteristics and features of the disclosed bed frame coupled firearm mount device herein have been shown herein, with reference to particular embodiments thereof, a latitude of modification, various changes, and substitutions are intended in the foregoing disclosure. It will be apparent that in some instances, some features of the gun mount device may be employed without a corresponding use of other features, without departing from the scope of the invention as set forth.

It should also be understood that various substitutions, modifications, and equivalent variations of components and construction may be made by those skilled in the art, upon viewing this disclosure, without departing from the spirit or scope of the invention. Consequently, all such modifications, equivalent variations, and substitutions are considered included within the scope of the invention as defined by the following claims.

What is claimed is:

1. A firearm mount comprising:

a body, said body having a first sidewall and a second sidewall;

a gap positioned between said first sidewall and said second sidewall;

a compressing connector;

said compressible connector for contacting a frame member of a bedframe positioned within said gap to hold said body in a compressive coupling with said frame member of a bedframe;

said body having a magnet thereon;

said magnet for forming a magnetic coupling a firearm to said body; and said magnetic coupling holding said firearm in a gripping position elevated above a support surface for said bedframe and adjacent an exterior sidewall of said frame member, whereby said firearm in said magnetic coupling is positionable between bedding hanging over said frame member and said body, whereby said firearm is hidden from view.

2. The firearm mount of claim 1 additionally comprising:

said firearm being a pistol; and said magnetic coupling of said firearm configured to hold said pistol in said gripping position having a barrel thereof in a horizontal disposition substantially paralleling said support surface with a handle thereof extending toward said support surface, whereby a user lying on said bed frame may grip said pistol while in said gripping position without viewing it.

3. The firearm mount of claim 1 additionally comprising:

said magnet being coupled to said second sidewall; and magnetic coupling of said firearm holding said firearm in said gripping position against an engagement surface connected to said second sidewall.

4. The firearm mount of claim 2 additionally comprising:

said magnet being coupled to said second sidewall; and magnetic coupling of said firearm holding said firearm in said gripping position against an engagement surface connected to said second sidewall.

5. The firearm mount of claim 3 additionally comprising:

said engagement surface having a polymeric coating thereon.

6. The firearm mount of claim 4 additionally comprising:

said engagement surface having a polymeric coating thereon.

7. The firearm mount of claim 2 additionally comprising:

said magnet being coupled to said second sidewall;

a holster having a pocket therein, said holster coupled to said second sidewall; and said magnetic coupling of said firearm holding said pistol in said gripping position with said barrel within said pocket.

8. The firearm mount of claim 1 additionally comprising:
said gap between said first sidewall and said second sidewall being adjustable in width.

9. The firearm mount of claim 2 additionally comprising:
said gap between said first sidewall and said second sidewall being adjustable in width.

10. The firearm mount of claim 3 additionally comprising:
said gap between said first sidewall and said second sidewall being adjustable in width.

11. The firearm mount of claim 4 additionally comprising:
said gap between said first sidewall and said second sidewall being adjustable in width.

12. The firearm mount of claim 1 additionally comprising:
an angled section of said second sidewall extending into said gap; and
said angled section for positioning against a top edge of said frame member with said body in said compressive coupling with said frame member.

13. The firearm mount of claim 2 additionally comprising:
an angled section of said second sidewall extending into said gap; and
said angled section for positioning against a top edge of said frame member with said body in said compressive coupling with said frame member.

14. The firearm mount of claim 3 additionally comprising:
an angled section of said second sidewall extending into said gap; and
said angled section for positioning against a top edge of said frame member with said body in said compressive coupling with said frame member.

15. The firearm mount of claim 7 additionally comprising:
an angled section of said second sidewall extending into said gap; and
said angled section for positioning against a top edge of said frame member with said body in said compressive coupling with said frame member.

16. The firearm mount of claim 8 additionally comprising:
a first horizontal section of said first sidewall extending into said gap;
a second horizontal section of said second sidewall, extending into said gap adjacent said first horizontal section; and
ribs extending from said first horizontal section being engageable with slots formed into said second horizontal section to thereby adjust said width of said gap.

17. The firearm mount of claim 9 additionally comprising:
a first horizontal section of said first sidewall extending into said gap;
a second horizontal section of said second sidewall, extending into said gap adjacent said first horizontal section; and
ribs extending from said first horizontal section being engageable with slots formed into said second horizontal section to thereby adjust said width of said gap.

18. The firearm mount of claim 10 additionally comprising:
a first horizontal section of said first sidewall extending into said gap;
a second horizontal section of said second sidewall, extending into said gap adjacent said first horizontal section; and
ribs extending from said first horizontal section being engageable with slots formed into said second horizontal section to thereby adjust said width of said gap.

19. The firearm mount of claim 3 wherein said magnet coupled to said second sidewall comprises:
a plurality of individual magnets in a sequence having gaps therebetween; and
adjacent said individual magnets in said sequence having an opposite magnetic polarity.

20. The firearm mount of claim 4 wherein said magnet coupled to said second sidewall comprises:
a plurality of individual magnets in a sequence having gaps therebetween; and
adjacent said individual magnets in said sequence having an opposite magnetic polarity.

* * * * *